US006015450A

United States Patent [19]

Joshi et al.

[11] Patent Number: 6,015,450

[45] Date of Patent: Jan. 18, 2000

[54] REDUCING METHANOL EMISSIONS FROM A SYNGAS UNIT

[75] Inventors: Girish Chimanlal Joshi, Sugar Land; Stephen Allen Noe, Tomball, both of Tex.

[73] Assignee: The M. W. Kellogg Company, Houston, Tex.

[21] Appl. No.: 09/133,477

[22] Filed: Aug. 13, 1998

[51] Int. Cl.[7] ..... B01D 53/14; B01D 53/047; B01D 19/00

[52] U.S. Cl. ..... 95/139; 95/166; 95/168; 95/180; 95/191; 95/237; 95/264; 96/108; 96/202; 96/290

[58] Field of Search ..... 95/139, 159, 162, 95/163, 166, 168, 169, 174, 177, 179, 180, 184, 186, 191, 237, 264; 96/108, 202, 203, 243, 290, 299

[56] References Cited

U.S. PATENT DOCUMENTS

| | | | |
|---|---|---|---|
| 2,992,703 | 7/1961 | Vasan et al. | 95/139 X |
| 3,008,807 | 11/1961 | Hilgert et al. | 96/203 X |
| 3,699,218 | 10/1972 | Smith et al. | 95/139 X |
| 3,841,058 | 10/1974 | Templeman | 95/139 X |
| 4,338,107 | 7/1982 | Swallow | 95/174 X |
| 4,708,721 | 11/1987 | Ehrler | 95/180 |
| 4,726,815 | 2/1988 | Hashimoto et al. | 95/139 X |
| 4,976,935 | 12/1990 | Lynn | 95/168 X |

*Primary Examiner*—Robert H. Spitzer
*Attorney, Agent, or Firm*—Kellogg Brown & Root, Inc.

[57] ABSTRACT

Methanol emissions in the $CO_2$ vent from a synthesis gas unit in an ammonia or hydrogen plant are reduced by contacting raw synthesis gas from a low temperature shift converter with recycled stripped condensate to absorb methanol. The synthesis gas is treated in a purification unit to form the $CO_2$ vent of reduced methanol content. The condensate from the contacting step is steam stripped to form a process steam stream suitable for feed to the reformer and a stripped process condensate stream suitable for offsites polishing, a portion of which is recycled for contacting the raw synthesis gas.

18 Claims, 3 Drawing Sheets

REDUCING METHANOL EMISSIONS FROM A SYNGAS UNIT

FIELD OF THE INVENTION

The present invention relates to the reduction of methanol emissions from a purification unit vent in synthesis gas generation units using low temperature shift catalyst.

BACKGROUND OF THE INVENTION

There is an ongoing desire to reduce atmospheric emissions from chemical plants, and particularly methanol emissions associated with ammonia plants. Reducing such methanol emissions has become critical for both new units and existing units undergoing revamps.

With reference to FIG. 1, in the prior art synthesis gas generation unit 10, such as in an ammonia or hydrogen plant, a hydrogen-rich stream 12 is supplied from a low temperature shift converter (not shown). The low temperature shift catalyst in the converter is typically used to improve shift reaction conversion of carbon monoxide and water to carbon dioxide ($CO_2$) and hydrogen. This service typically employs a copper-based catalyst which under typical conditions of operation supports some formation of by-products such as methanol from the reactants which are present. Downstream of the shift section, the process stream 12 is cooled in cooler 14 to condense water which is separated from the gas in knock-out drum 16 to form condensate stream 18 and overhead gas stream 20. The condensed process condensate which has a typical methanol content of 500–1000 ppmw is sent by pump L9 to a condensate stripper 22 after heating in condensate stripper feed/effluent heat exchanger 24. Fresh steam is supplied in line 26 to strip contaminants such as ammonia, methanol and higher alcohols and $CO_2$ from the condensed process condensate in condensate stripper 22. Steam containing the contaminants is recovered overhead via line 28 and supplied to a steam reformer (not shown) via line 30 along with steam by-passing the condensate stripper 22 via line 32. Stripped condensate is recovered as a bottoms stream from condensate stripper 22 via line 34 and can be polished offsite or otherwise processed.

Methanol present in the process gas in line 20 is sent to a purification unit 36 for removal of $CO_2$ and/or other non-desirable components in the syngas product. The purification unit 36 is typically an absorber-stripper system or a mole sieve system such as a pressure-swing adsorption (PSA) unit. Purified syngas is obtained in line 38. The methanol comes out in a $CO_2$-rich overhead product stream 40. In many cases, at least a part of this $CO_2$ stream 40 is vented to the atmosphere along with any methanol which may be present therein.

It would be desirable to have available a way of reducing the methanol emissions in the $CO_2$ from the purification unit 36. Ideally, the means for reducing the methanol emissions would minimize additional equipment requirements, would have a minor impact on plant energy consumption, and would not produce solid contaminants which require disposal. Conventional methanol reduction technology such as end-of-pipe catalytic reactors, or alternatively refrigerating the raw syngas to increase methanol separation in knock-out drum 16, do not meet these criteria. The end-of-pipe catalytic reactor requires a blower, a heater (for start-up purposes) and an oxidation reactor, and produces spent catalyst which must be disposed of. Refrigerating the raw syngas would require refrigeration equipment and severe power consumption. Therefore, a need exists for an acceptable way of reducing the methanol emissions.

SUMMARY OF THE INVENTION

The present invention removes most of the methanol from the synthesis gas exiting the knock-out drum, thereby reducing emissions from the carbon dioxide overhead product from the purification unit. The bottoms stream from the condensate stripper generally has a methanol level which is quite low. According to the present invention, some of this stripped condensate is recycled to the knock-out drum upstream of the purification unit. Also, the knock-out drum is expanded to incorporate a wash section comprising packing or trays above the main process gas inlet. The recycled stripped condensate is then introduced as a scrubbing medium to the top of the wash section in the knock-out drum. Process gas exiting the wash section will therefore be near equilibrium with water having a very low methanol content, rather than the 500 to 1000 ppmw methanol that was present in the condensed process condensate before recycle of the stripped condensate stream. Methanol emissions to the atmosphere from the $CO_2$ vent will therefore be reduced accordingly. The additional methanol removed ends up in the steam feed to the reformer so that it is not released into the atmosphere.

Unlike other potential options to treat the $CO_2$ vented from the stripper, the proposed design adds no new equipment. Items in the recycling process circuit will see some increase in size, such as the process condensate pump, condensate stripper, stripper feed/effluent exchanger and the knock-out drum. However, increasing the size of existing equipment rather than adding new equipment typically results in minimum cost. In addition, the impact on plant energy consumption is very minor. There is a slight increase in air and mixed feed preheat coil duties in the reformer, due to a slight decrease in steam feed temperature. However, this is somewhat offset by a reduction in process steam extracted from the steam header.

In one aspect, then, the present invention provides a method for processing a raw synthesis gas stream to minimize methanol emissions. The method comprises contacting the raw synthesis gas stream with stripped condensate to form an overhead synthesis gas stream of reduced methanol content and a condensate stream enriched in methanol. The methanol-enriched condensate stream is steam stripped to form a process steam stream enriched in methanol and a stripped condensate stream of reduced methanol content. A portion of the stripped condensate stream is recirculated to the contacting step. The overhead synthesis gas stream is treated in a purification unit to form a $CO_2$-rich stream essentially free of methanol and a synthesis gas stream of reduced $CO_2$ content.

In another aspect, the present invention provides a unit for processing raw synthesis gas to produce a synthesis gas stream of reduced water and $CO_2$ content, a $CO_2$ stream of low methanol content, a stripped condensate stream essentially free of hydrocarbons and other impurities, and a process steam stream suitable for feed to a reformer. The unit has a raw gas separator including a methanol wash bed for contacting a raw synthesis gas stream with stripped condensate to form an overhead synthesis gas stream of reduced methanol content and a condensate stream enriched with methanol. A process condensate stripper is provided for contacting the methanol-enriched condensate stream with steam to form a process steam stream overhead and a bottoms stream comprising stripped condensate. A line recirculates a portion of the stripped condensate stream from the process condensate stripper to the raw gas separator. A purification unit treats the overhead synthesis gas stream from the raw gas separator to form a $CO_2$-lean synthesis gas stream and a $CO_2$-rich stream of low methanol content.

In a further aspect, the present invention provides an improvement in a method for processing a raw synthesis gas stream comprising the steps of (1) separating condensate from the raw synthesis gas stream to produce a condensate stream and a synthesis gas stream of reduced water content, (2) treating the synthesis gas stream in a purification unit to form a $CO_2$-lean synthesis gas stream and a $CO_2$-rich product stream, and (3) steam stripping the condensate stream from step (1) to form a process steam stream suitable for reforming and a stripped process condensate stream. The improvement is that the separating step (1) includes contacting the raw synthesis gas stream with a portion of the stripped process condensate stream effective to substantially reduce the methanol content of the $CO_2$ product stream from step (2).

DESCRIPTION OF THE INVENTION

Figure 1:
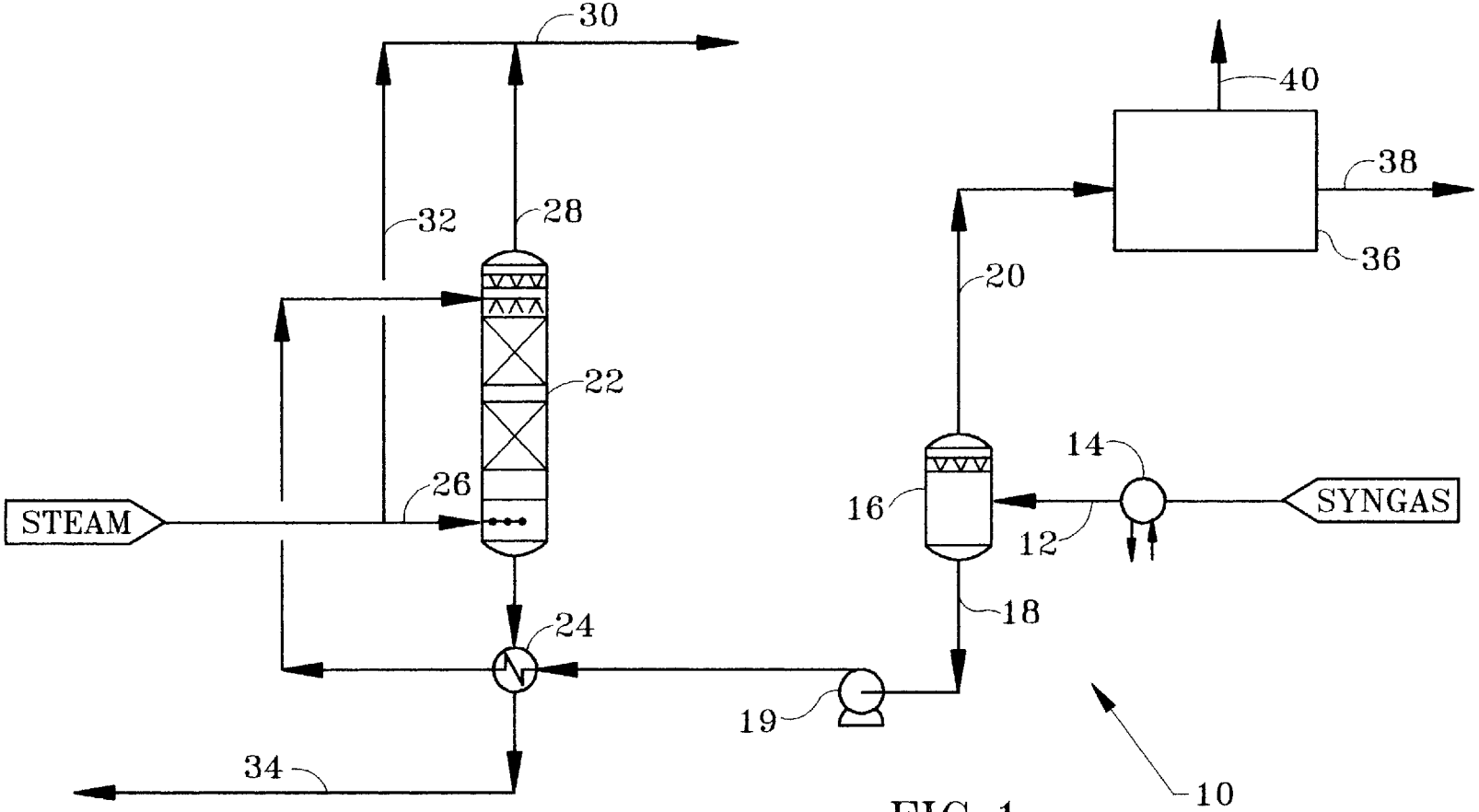
FIG. 1 (PRIOR ART)
FIG. 1 is a simplified process diagram of the prior art method for processing a raw synthesis gas stream to produce a synthesis gas stream of reduced water and $CO_2$ content, a $CO_2$ stream, a stripped condensate stream essentially free of hydrocarbons and other impurities, and a process steam stream suitable for feed to a reformer.
Figure 2:
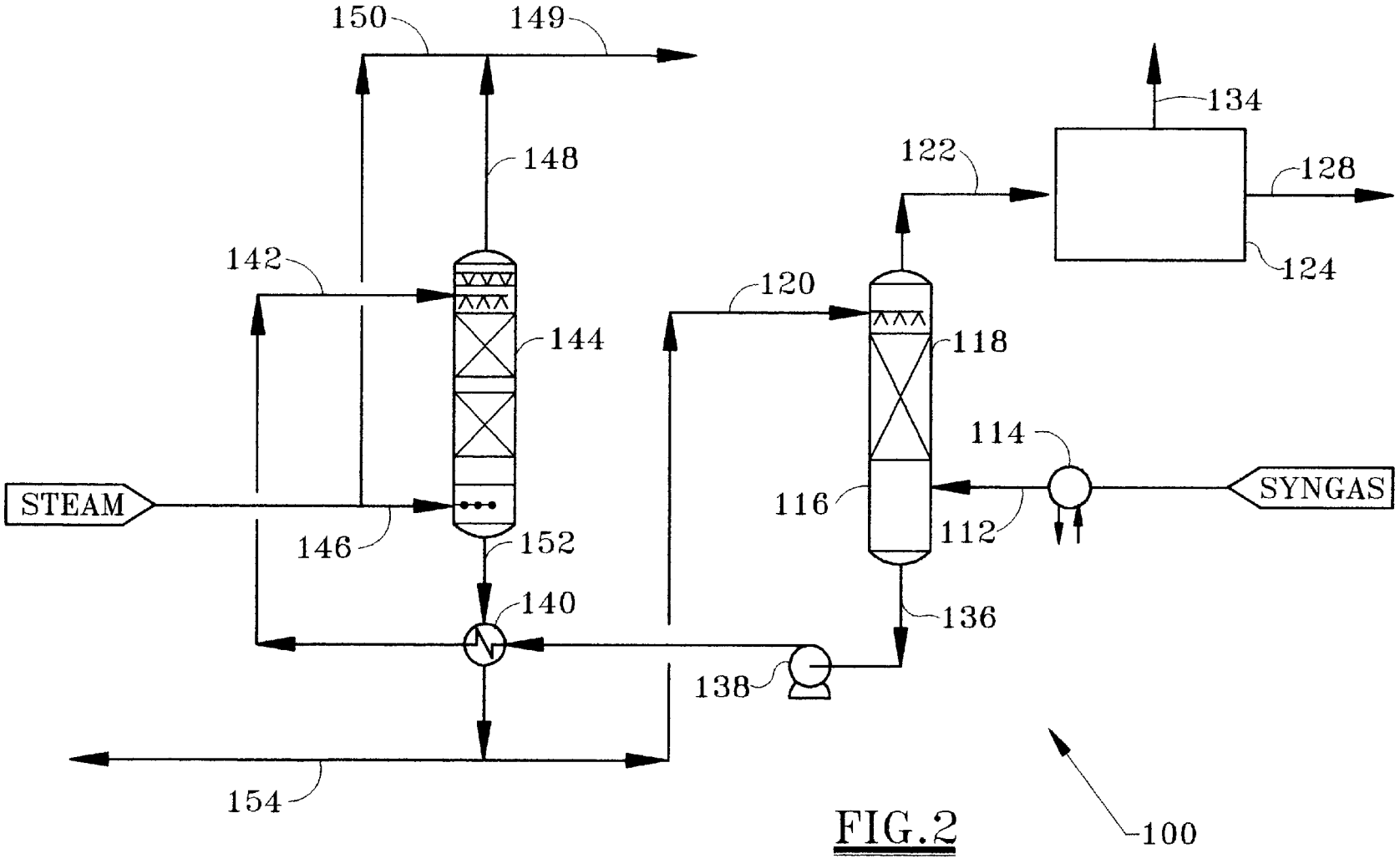
FIG. 2 is a simplified process flow diagram according to the present invention wherein the process of FIG. 1 is modified so that the $CO_2$ stream has a substantially reduced methanol content.

According to one embodiment of the present invention shown in FIG. 2, the unit 100 receives synthesis gas stream 112 supplied from a conventional low temperature shift converter which usually employs a copper-based catalyst. The catalyst typically results in the formation of some by-products such as ammonia, methanol and higher alcohols. The syngas stream 112 is basically the same as the syngas stream 12 in FIG. 1.

The syngas stream 112 is cooled in cooler 114 by indirect heat exchange with cooling water or a process stream, for example. The cooled syngas stream from the cooler 114 is a two-phase stream containing some process condensate. This two-phase stream is supplied to a separator 116. The condensate is collected at the bottom of the separator 116, while the gas proceeds upwardly through a water wash section 118. Stripped condensate is introduced to the top of the wash section 118 via line 120.

The stripped condensate in line 120 is essentially free of methanol, for example, less than 100 ppmw, especially less than 25 ppmw methanol. The stripped condensate introduced via line 120 serves as a scrubbing medium in the wash section 118. Process gas exiting the wash section 118 is generally near equilibrium with the stripped condensate containing less than 25 ppmw methanol, rather than about 500 to 1000 ppmw methanol which is present in the condensed process condensate in the two-phase stream from the cooler 114. The methanol content in overhead gas stream 122 is thus reduced by more than 90%.

The overhead gas stream 122 from the wash section 118 is introduced to the purification unit 124 for removal of $CO_2$, methanol and other impurities. The purification unit 124 can be any conventional purification system employed for $CO_2$ removal, such as, for example a Benfield solution or MDEA absorption-stripping system, or a mole-sieve based unit such as a pressure-swing adsorption system. Treated syngas product stream 128 is essentially free of $CO_2$ and methanol. A $CO_2$ stream 134 is produced which typically contains any methanol carried over in line 122.

Figure 3:
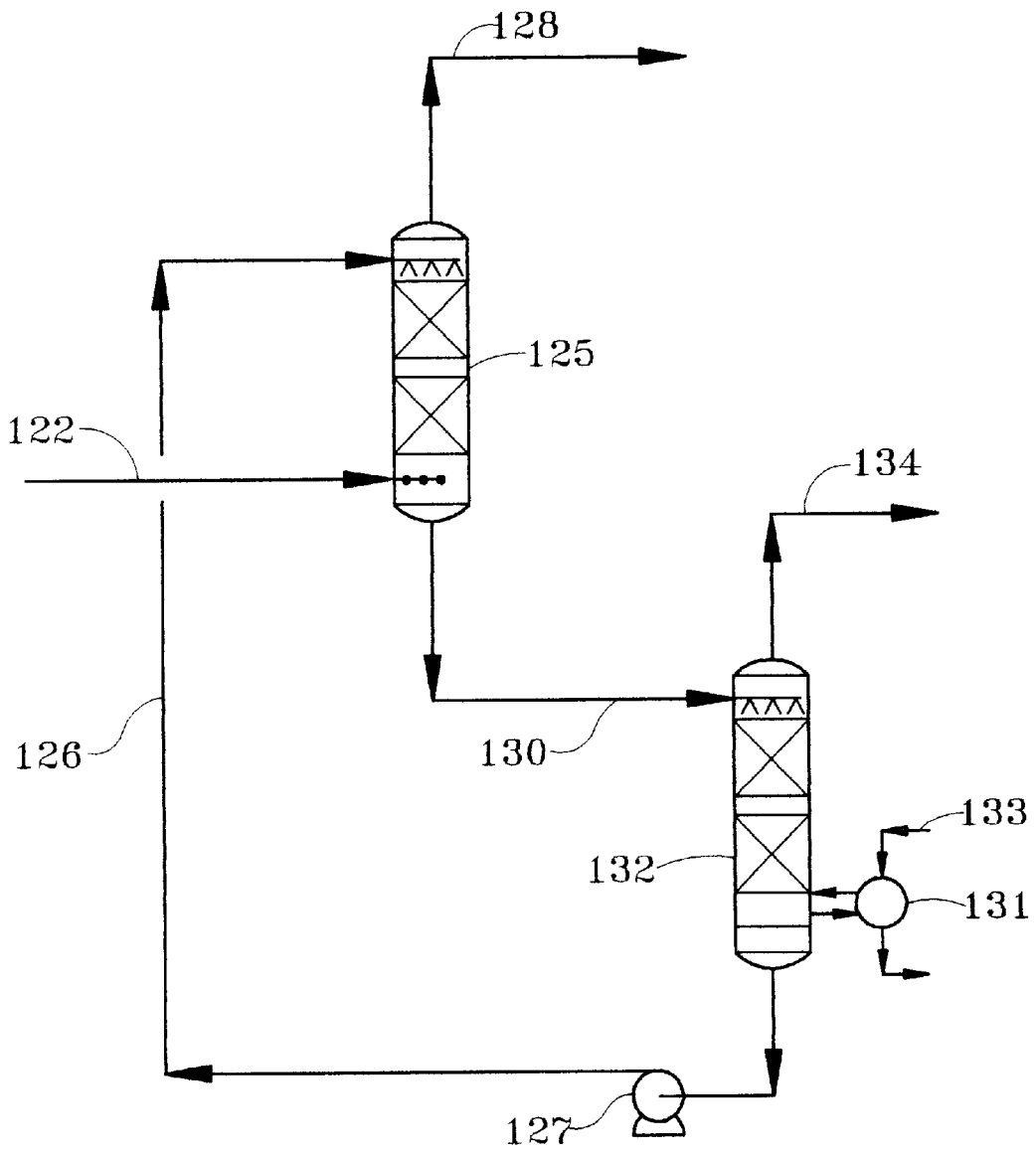
FIG. 3 is a simplified process flow diagram showing a typical absorber-stripper unit suitable as one embodiment of the purification unit 124 in FIG. 2.

With reference to the absorption-stripping system shown in FIG. 3, the overhead gas stream 122 from the wash section 118 is introduced to the bottom of $CO_2$ absorber 125. Lean absorbent is introduced to the top of the absorber 125 via line 126 and pump 127. The absorbent passing down through the absorber 125 contacts the gas and absorbs $CO_2$ therefrom. An overhead product stream 128 is essentially free of $CO_2$ and methanol which is absorbed in the absorbent medium. A $CO_2$-rich absorbent is recovered as a bottoms product stream 130 and introduced to the top of a stripper 132 which is conventionally heated via reboiler 131 and steam or hot syngas supplied via line 133, and may also operate at a lower pressure than the absorber 125. A $CO_2$ overhead stream 134 is produced which typically contains any methanol carried over in line 130. A $CO_2$-lean stream is recovered as a bottoms product from the stripper 132 for recycle via line 126 and pump 127 to the absorber 125.

Referring again to FIG. 2, the liquid bottoms stream 136 is supplied by pump 138 through condensate stripper/feed effluent heat exchanger 140 and line 142 to the top of condensate stripper 144. Steam, preferably superheated steam, is introduced in line 146 to the bottom of the stripper 144 to strip impurities from the condensate which are carried overhead in saturated steam line 148. Additional steam required for the reformer (not shown) is supplied in stripper bypass line 150. Stripped condensate is collected from the bottom of the stripper 144 in line 152 and cooled in heat exchanger 140 to heat the incoming process condensate in line 142. A portion of the stripped condensate is sent to the separator 116 via line 120 as previously mentioned and the remainder can be sent to further processing via line 154, for example, offsites polishing.

Generally, from 10 to 50 percent of the stripped condensate in line 152 is recycled via line 120 to the top of the water wash section 118, preferably from 20 to 40 percent. In general, the more stripped condensate recycled, the lower the methanol content in the overhead gas line 122; however, increased condensate recycle will require more steam via line 146 for stripping. There is some small energy penalty from the relatively lower temperature in line 149, but this is largely offset by less steam from the steam header required for a fixed amount of steam in line 149 to be supplied to the reformer (not shown).

EXAMPLE

A syngas conditioning unit for a 1000 metric tons per day ammonia plant was simulated to compare a conventional conditioning unit (with high methanol emissions in the $CO_2$ vent) with a syngas conditioning unit based on the principles of the present invention (with reduced methanol emissions in the $CO_2$ vent). The material balance for the simulation for the base case (FIG. 1) is presented in Table 1.

TABLE 1

| | STREAM | | | | | | | | |
|---|---|---|---|---|---|---|---|---|---|
| | 12 | 20 | 44 | 18 | 34 | 32 | 26 | 28 | 30 |
| COMPONENT (lb-mole/hr) | | | | | | | | | |
| Hydrogen | 15,647.00 | 15,643.0 | 27.10 | 4.00 | — | — | — | 4.00 | 4.00 |
| Nitrogen | 5,919.76 | 5,918.80 | 5.20 | 0.96 | — | — | — | 0.96 | 0.96 |
| Methane | 180.50 | 180.40 | 0.50 | 0.10 | — | — | — | 0.10 | 0.10 |
| Argon | 73.84 | 73.80 | — | 0.04 | — | — | — | 0.04 | 0.04 |
| Carbon Dioxide | 5,201.84 | 5,178.10 | 5,166.50 | 23.74 | 0.04 | — | — | 23.71 | 23.71 |
| Carbon Monoxide | 69.74 | 69.70 | — | 0.04 | — | — | — | 0.04 | 0.04 |
| Methanol | 5.42 | 0.90 | 0.90 | 4.52 | 0.24 | — | — | 4.28 | 4.28 |
| Water | 13,932.00 | 249.00 | 298.40 | 13,683.00 | 13,090.66 | 10,943.26 | 5,473.20 | 6,065.54 | 17,008.80 |
| Total (lb-mole/hr) | 41,030.1 | 27,313.7 | 5,498.6 | 13,716.4 | 13,090.9 | 10,943.3 | 5,473.2 | 6,098.7 | 17,041.9 |
| Total (lb/hr) | 685,266 | 437,535 | 232,990 | 247,731 | 235,840 | 197,145 | 98,601 | 110,492 | 307,637 |
| Mw | 16.702 | 16.702 | 42.373 | 18.061 | 18.016 | 18.015 | 18.015 | 18.117 | 18.052 |
| Temperature (° F.) | 158 | 158 | 100 | 158 | 178 | 728 | 728 | 498 | 645 |
| Pressure (psia) | 554.0 | 552.0 | 17.4 | 552.0 | 600.0 | 675.0 | 675.0 | 670.0 | 665.0 |

As seen in Table 1, the $CO_2$ vent line 44 contains the methanol from the overhead line 20. The $CO_2$ vent line has about 125 ppmw methanol for a total annual discharge of about 115 metric tons per year.

Using the principles of the present invention, about 33% of the stripped condensate stream 152 is fed to the top of the raw gas separator 116 which has been modified to include a water wash bed 118. No new equipment is needed for this configuration. The height of the separator 116 is roughly 3.35 times the height of the base case separator 16 to include the water wash bed 118, but the diameter is unchanged. The diameter of the condensate stripper 144 is roughly 15% greater than the base case condensate stripper 22 to accommodate the greater volume of condensate stripping. The heat transfer area of exchanger 140 is similarly roughly 31% greater than that of the base case heat exchanger 24, and the capacity of pump 138 is also roughly 31% greater than the base case pump 19. The cooler 114 has about the same size and duty as the base case cooler 14 (for simplicity in simulation, the raw gas is cooled to 153° F., versus 158° F. in the base case, to obtain the same overhead temperature (158° F.) in line 122 as in line 20). The results of the simulation are presented in Table 2.

As seen in table 2, the amount of methanol in the $CO_2$ vent line 134 is reduced to about 8 ppmw, and the total annual discharge to less than 8 metric tons.

We claim:

1. A method for processing a raw synthesis gas stream to minimize methanol emissions, comprising the steps of:

(a) contacting the raw synthesis gas stream with condensate to form an overhead synthesis gas stream of reduced methanol content and a condensate stream enriched in methanol;

(b) steam stripping the methanol-enriched condensate stream to form a process steam stream enriched in methanol and a stripped condensate stream of reduced methanol content;

(c) recirculating a portion of the stripped condensate stream for the contacting step (a);

(d) treating the overhead gas stream in a purification unit to form a $CO_2$-rich stream essentially free of methanol and a synthesis gas stream of reduced $CO_2$ content.

2. The method of claim 1 wherein the stripped condensate contains less than 100 ppm methanol.

3. The method of claim 1 wherein the stripped condensate contains about 25 ppm methanol or less.

TABLE 2

| | STREAM | | | | | | | | | |
|---|---|---|---|---|---|---|---|---|---|---|
| | 112 | 122 | 134 | 136 | 154 | 120 | 150 | 146 | 148 | 149 |
| COMPONENT (lb-mole/hr) | | | | | | | | | | |
| Hydrogen | 15,647.00 | 15,641.76 | 27.10 | 5.24 | — | — | — | — | 5.24 | 5.24 |
| Nitrogen | 5,919.76 | 5,918.50 | 5.20 | 1.26 | — | — | — | — | 1.26 | 1.26 |
| Methane | 180.50 | 180.37 | 0.50 | 0.13 | — | — | — | — | 0.13 | 0.13 |
| Argon | 73.84 | 73.79 | — | 0.05 | — | — | — | — | 0.05 | 0.05 |
| Carbon Dioxide | 5,201.84 | 5,170.73 | 5,159.10 | 31.11 | 0.03 | 0.01 | — | — | 31.08 | 31.08 |
| Carbon Monoxide | 69.74 | 69.69 | — | 0.05 | — | — | — | — | 0.05 | 0.05 |
| Methanol | 5.42 | 0.06 | 0.06 | 5.42 | 0.18 | 0.06 | — | — | 5.18 | 5.18 |
| Water | 13,932.00 | 248.91 | 298.40 | 17,931.16 | 12,906.85 | 4,248.07 | 9,060.09 | 7,172.47 | 7,948.71 | 17,008.80 |
| Total (lb-mole/hr) | 41,030.1 | 27,303.8 | 5,490.4 | 17,974.4 | 12,907.1 | 4,248.1 | 9,060.1 | 7172.5 | 7,991.7 | 17,051.8 |
| Total (lb/hr) | 685,266 | 437,170 | 232,637 | 324,628 | 232,526 | 76,532 | 163,219 | 129,213 | 144,783 | 308,002 |
| Mw | 16.702 | 16.702 | 42.372 | 18.061 | 18.015 | 18.015 | 18.015 | 18.015 | 18.117 | 18.063 |
| Temperature (° F.) | 153 | 158 | 100 | 153 | 173 | 173 | 728 | 728 | 498 | 620 |
| Pressure (psia) | 554.0 | 552.0 | 17.4 | 552.0 | 600.0 | 600.0 | 675.0 | 675.0 | 670.0 | 665.0 |

4. The method of claim 1 comprising the step of indirectly exchanging heat between the stripped condensate stream and the methanol-enriched condensate stream.

5. The method of claim 1 wherein the recirculated portion of the stripped condensate in step (c) comprises from 10 to 50 weight percent of the stripped condensate stream from step (b).

6. The method of claim 1 wherein the treating step (d) comprises the steps of (1) contacting the overhead gas stream with a $CO_2$ absorbent to form a $CO_2$-rich absorbent stream, and (2) stripping the $CO_2$-rich absorbent stream to obtain a $CO_2$-lean absorbent stream for recirculation to step (1).

7. The method of claim 1 wherein the purification unit comprises pressure-swing adsorption.

8. In a method for processing a raw synthesis gas stream comprising the steps of (1) separating condensate from the raw synthesis gas stream to produce a condensate stream and a synthesis gas stream of reduced water content, (2) treating the synthesis gas stream in a purification unit to form a $CO_2$-lean synthesis gas stream and a $CO_2$-rich stream, and (3) steam stripping the condensate stream from step (1) to form a process steam stream suitable for reforming and a stripped process condensate stream, the improvement wherein the synthesis gas stream upstream from the purification unit is contacted with a portion of the stripped process condensate stream effective to substantially reduce the methanol content of the $CO_2$ stream from step (2) and produce a methanol-enriched condensate stream.

9. The improvement of claim 8 wherein the stripped process condensate stream comprises less than 100 ppm methanol.

10. The improvement of claim 8 wherein the stripped process condensate stream comprises about 25 ppm methanol or less.

11. The improvement of claim 8 wherein the methanol-enriched condensate stream is heated by indirect heat exchange against the stripped process condensate from step (3).

12. The improvement of claim 8 wherein the portion of the stripped process condensate stream with which the raw synthesis gas stream is contacted comprises from 10 to 50 weight percent of the stripped process condensate stream.

13. The improvement of claim 8 wherein the purification unit comprises an absorber-stripper unit.

14. The improvement of claim 8 wherein the purification unit comprises a mole-sieve unit.

15. A unit for processing raw synthesis gas to produce a synthesis gas stream of reduced water and $CO_2$ content, a $CO_2$ stream essentially free of methanol, a stripped condensate stream essentially free of hydrocarbons and other impurities, and a process steam stream suitable for feed to a reformer, comprising:

a raw gas separator including a water wash section for contacting a raw synthesis gas stream with stripped condensate to form an overhead synthesis gas stream of reduced methanol content and a condensate stream enriched with methanol;

a process condensate stripper for contacting the methanol-enriched condensate stream with steam to form a process steam stream overhead and a bottoms stream comprising stripped condensate;

a line for recirculating a portion of the stripped condensate stream from the process condensate stripper to the raw gas separator;

a purification unit for treating the overhead synthesis gas stream from the raw gas separator to form a $CO_2$-lean synthesis gas stream and a $CO_2$-rich stream.

16. The unit of claim 15 comprising a heat exchanger for indirectly exchanging heat between the bottoms stream from the process condensate stripper and the methanol-enriched condensate stream.

17. The unit of claim 15 wherein the purification unit comprises an absorber-stripper unit.

18. The unit of claim 15 wherein the purification unit comprises a mole-sieve unit.

* * * * *